US005158075A

United States Patent [19]

Howard

[11] Patent Number: 5,158,075

[45] Date of Patent: Oct. 27, 1992

[54] VIBRATING DEVICE

[76] Inventor: Howard S. Howard, 10-10 44th Ave., Long Island City, N.Y. 11101

[21] Appl. No.: 296,621

[22] Filed: Jan. 13, 1989

[51] Int. Cl.[5] ..... A61H 1/00

[52] U.S. Cl. ..... 128/41; 128/63; 128/36

[58] Field of Search ..... 128/63, 62 R, 24.1, 128/32, 58, 41–44, 33, 36

[56] References Cited

U.S. PATENT DOCUMENTS

| | | | |
|---|---|---|---|
| 1,805,853 | 5/1931 | Smith | 128/63 |
| 2,096,646 | 10/1937 | Thornton-Norris | 128/25 B |
| 3,115,139 | 12/1963 | Schneider | 128/36 X |
| 3,636,945 | 1/1972 | Sato | 128/58 X |
| 3,896,795 | 7/1975 | Solhkhah | 128/32 |
| 3,921,625 | 11/1975 | Feather | 128/63 |
| 3,996,929 | 12/1976 | Mabuchi | 128/58 |
| 4,136,685 | 1/1979 | Ramey | 128/33 |
| 4,343,303 | 8/1982 | Williams | 128/32 |
| 4,732,140 | 3/1988 | Stoffregen | 128/34 X |
| 4,935,972 | 1/1990 | Brady | 128/33 X |

*Primary Examiner*—Robert A. Hafer
*Assistant Examiner*—Brian E. Hanlon

[57] ABSTRACT

A vibrating device embodied at the middle of a sling which has hooks at opposite ends, so that in use the hooks are attached to the door knobs of an open door, and the user stands within the sling and leans back against the vibrator which is then positioned against the user's back, and the door supports this leaning position of the user.

1 Claim, 1 Drawing Sheet

VIBRATING DEVICE

The present invention relates generally to a body massaging or vibrating device, and more particularly to improvements in the construction thereof which significantly facilitates the use of the device.

It is already well known from the disclosure of U.S. Pat. No. 3,921,625 issued to Feather on Nov. 25, 1975, that a vibrator, embodied in a sling, can be placed about the user and be supported by the remote ends of the sling from an object conveniently accessible to the area of use. Thus, in the referenced patent, the ends of the sling are connected to a door and, more particularly, to a plate (18) held in place between the door frame and the hinged edge of the closed door.

In accordance with the present invention use is also made of a vibrator-sling device and, like the aforesaid patent, the sling ends are also supported on a door. However, the within inventive sling is constructed to be attached to the laterally oppositely extending door knobs of an open door, thereby obviating the need to lodge or otherwise set-up a connecting plate or the like for the sling ends between a door edge and its frame. This greatly facilitated set-up and other noteworthy benefits characterize, and distinguish, the within inventive vibrating device from the prior art.

Figure 1:
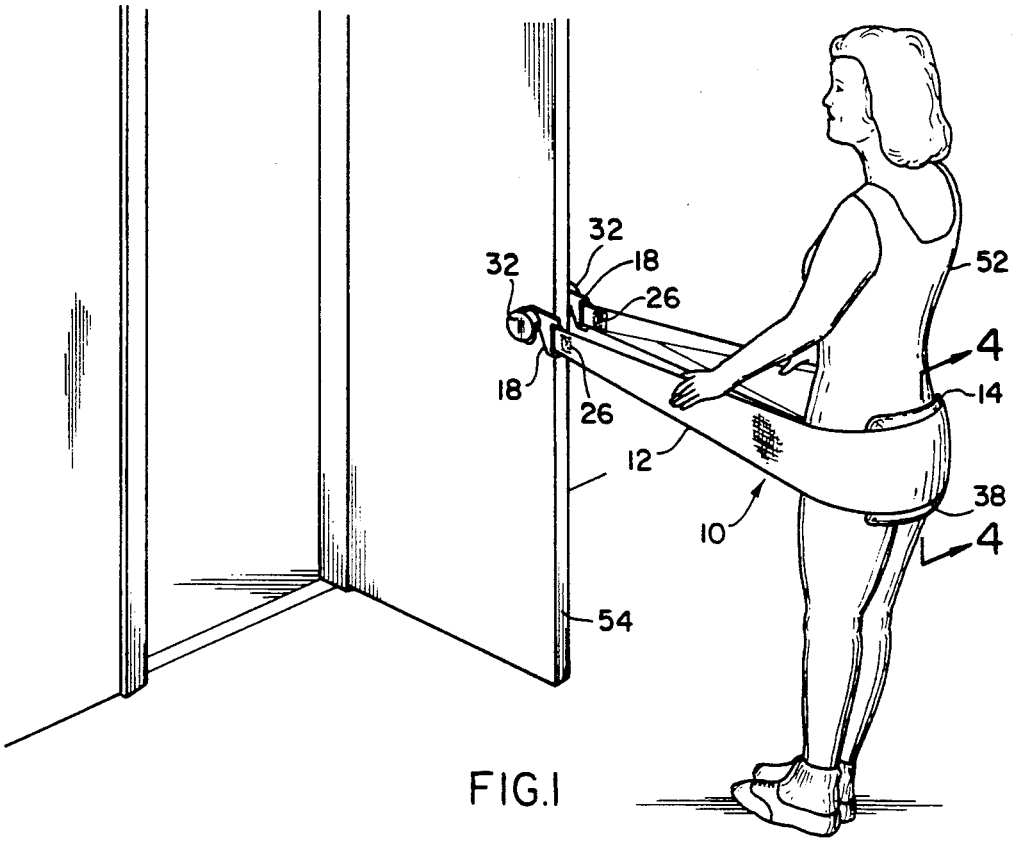
FIG. 1 is a perspective view of the sling vibrator device hereof in use.
Figure 2:
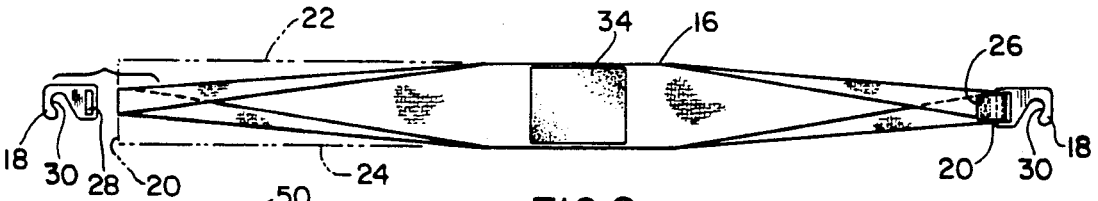
FIG. 2 is an elevational view of the inner surface of the sling portion of the device.
Figure 3:
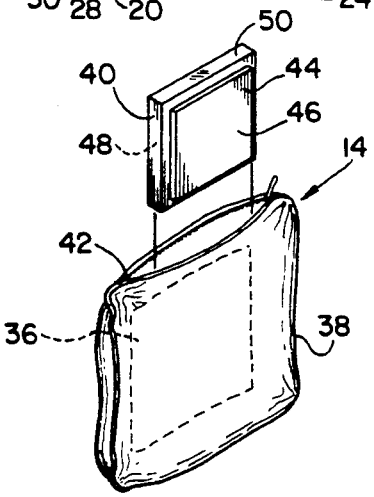
Figure 4:
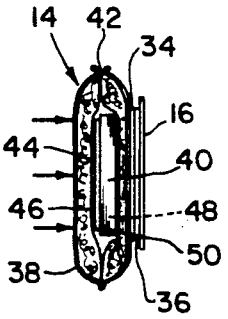
Figure 2A:
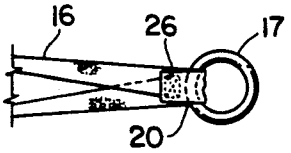
Figure 2B:
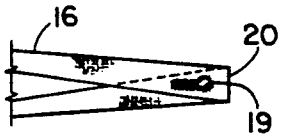

FIG. 2*a* is a partial view of the device similar to FIG. 2, but showing an alternate door knob-engaging end construction;

FIG. 2*b* is a view similar to FIG. 2*a*, showing yet another construction suitable for knob-engaging service;

FIG. 3 is a spaced apart perspective view of the vibrating component and its cushioned container; and FIG. 4 is a cross sectional view, taken along line 4—4 in FIG. 1, showing further structural details.

The within inventive device is a vibratory massage mechanism, designated 10, of the type used to relax tired or aching muscles, and is shown as intended to be used in FIG. 1. The device 10 is comprised of a fabric sling 12 and a vibration generator unit 14, both of which are already generally known, but not either known or used in the manner illustrated in FIG. 1, in which the same support for the door 54 to which the sling 12 is conveniently and readily attached is advantageously also used to support the leaning weight of the user 52. This and other advantages over the prior art will become apparent as the description proceeds.

Sling 12 is made from webbing 16 and includes a pair of hook plates 18. Webbing 16 is woven of Nylon or other strong, lightweight fabric and is formed, in this case, from a blank 8" wide and 8'-0" long. In FIG. 2 in which the inside surface of the belt assembly is shown in elevation, it will be noted at both opposite ends that the top 22 and the bottom 24 pair of edges of the webbing 16 are folded in tapered fashion towards the horizontal middle portion. This folding provides a three ply configuration which allows for ends 20 of webbing 16 to be more easily joined to hook plates 18, as by stitching 26. Hook plates 18 are preferably made as heavy sheet metal stampings, which are plastic coated after deburring, both of which minimize local wear on the webbing 16.

Each hook in plate 18 is made with a rectangular opening 28 through which are threaded the folded ends 20 of webbing 16 and at its opposite end has a hook at 30 shaped and sized to fit about the shank of a conventional door knob 32.

Alternatively, rings 17 (FIG. 2*a*) may be substituted for hook plates 18. Rings 17 can be of metal or plastic and are selected to be large enough to fit over the door knobs 32. Still another treatment of the outer ends 20 of webbing 16 is shown in FIG. 2*b*, and consists of an opening 19 made to resemble an oversized buttonhole and adapted in practice to be slipped over the knobs 32. The referenced knobs 32 are, of course, to be understood to be those conventionally found on any door 52, which may be for a closet, bedroom, bathroom, or the like.

At the midpoint location along the sling 12 a Velcro hook patch 34 is to be located, as shown in FIG. 2. Patch 34 is provided as anchor means for the vibration generator 14 positioned at the mid-point location 34, said generator 14 being fitted with a like Velcro patch 36 but with hook-engaging loops. Generator unit 14 preferred for use is a well padded, pillow-like pocket 38, which contains commercially available vibration means 40 (not shown in detail). Pocket 38 can be zippered along edge 42 for ready access to unit 40. The vibrator itself may be of an eccentric rotary type or a reciprocating electromagnet/armature type powered by standard alkaline batteries or rechargeable nickel-cadmium batteries for cordless application, or low voltage AC. Even a mechanical spring-powered windup device might be employed.

Regardless of the power source, the vibration unit 40 is to have an on-off switch, for obvious reasons. The switch 44 most desirable for purposes of the within invention is shown in FIGS. 3 and 4 and is of the pressure type. To this end, switch 44 has a broad surface 46 which cooperates with the vibration circuit 48 within housing 50. When the user 52 (FIG. 1) leans against the pillow-like pocket 38, the user's weight is manifested as pressure applied to surface 46 which closes switch 44 and activates circuit 48. Switch 44 is spring biased to the open position, and this thus is the normal mode of the switch. Thus, only when the spring bias is overcome is switch 44 in its on mode, and the vibrating means 40 in vibrating service. This type switch 44 insures that power is not wasted.

Once the massage device is assembled with an adequate power source, the user 52 merely secures hook plates 18 (or connectors 17 or 19) about the shanks of door knobs 32 and with the vibration unit 14 attached to the webbing 16 via Velcro hooks 34 and loops 36, and is required only to lean against the vibrator 14 with his/her buttocks. This action results in pressure on surface 46 and activation of the vibration mechanism 40, until this pressure is released.

From the foregoing description it should be readily appreciated that the set-up attachment of the within sling vibrator 10 hereof is greatly facilitated using the door knobs 32, and that the same support structure for the door 54 readily also serves as the support for the vibrator 10.

What is claimed is:

1. As an attachment to a door having a pair of laterally extending door knobs, a vibrator comprising a sling of fabric construction material folded in a U-shaped configuration presenting opposite ends and between said ends an operative mid-point location on an inside surface thereof, a vibrating means operatively connected to said mid-point location, interengaging velcro patches at said mid-point location and on said vibrating means to complete the attachment of said vibrating means to said sling, at each said opposite end a door-knob engaging hook for supporting said sling in an encircling relation about a user in a position leaning away from said door and against said vibrating means, and an on-off switch for said vibrating means of the type in which the off mode is the normal mode as provided by spring bias such that said vibrator is correspondingly only on when pressure is applied against said switch overcoming said spring bias as occurs when the user leans away from said door and against said vibrating means, whereby the support of said door also serves as a support for said vibrator during the use thereof.

* * * * *